US007997029B2

(12) United States Patent
Kim

(10) Patent No.: US 7,997,029 B2
(45) Date of Patent: Aug. 16, 2011

(54) SUB-ARM ASSEMBLY FOR WINDOW REGULATOR

(75) Inventor: Seong Han Kim, Anyang-si (KR)

(73) Assignee: Hyundai Motor Company, Seoul (KR)

( * ) Notice: Subject to any disclaimer, the term of this patent is extended or adjusted under 35 U.S.C. 154(b) by 144 days.

(21) Appl. No.: 12/397,065

(22) Filed: Mar. 3, 2009

(65) Prior Publication Data

US 2010/0018124 A1 Jan. 28, 2010

(30) Foreign Application Priority Data

Jul. 24, 2008 (KR) ..... 10-2008-0072372

(51) Int. Cl.
*E05F 11/44* (2006.01)

(52) U.S. Cl. ..... 49/351; 49/350

(58) Field of Classification Search ..... 49/348, 49/349, 350, 351
See application file for complete search history.

(56) References Cited

U.S. PATENT DOCUMENTS

| | | | | |
|---|---|---|---|---|
| 5,195,211 | A * | 3/1993 | Krajenke | 16/95 R |
| 5,201,144 | A * | 4/1993 | Krajenke | 49/351 |
| 5,586,362 | A * | 12/1996 | Baker | 16/193 |
| 2005/0091929 | A1 * | 5/2005 | Shibata | 49/350 |

FOREIGN PATENT DOCUMENTS

| | | | |
|---|---|---|---|
| KR | 2002-0038215 | A | 5/2002 |
| KR | 10-0610196 | B1 | 8/2006 |
| KR | 10-2007-0036291 | A | 4/2007 |

* cited by examiner

*Primary Examiner* — Jerry Redman
(74) *Attorney, Agent, or Firm* — Morgan, Lewis & Bockius LLP

(57) ABSTRACT

A sub-arm assembly of a window regulator may include a sub-arm which is pivotally coupled to a main arm of a window regulator in a letter X shape, wherein upper ends of the sub arm and the main arm are configured to support a lower end of glass and a lower end of the sub-arm is configured to be slidable on a base panel; a sliding bar pivotally coupled the lower end of the sub-arm; and a guide rail integrally formed with the base panel so as to extend from the base panel and having a space to slidably receive the sliding bar.

9 Claims, 6 Drawing Sheets

SUB-ARM ASSEMBLY FOR WINDOW REGULATOR

CROSS-REFERENCE TO RELATED APPLICATIONS

The present application claims priority to Korean Patent Application No. 10-2008-0072372, filed on Jul. 24, 2008, the entire contents of which application is incorporated herein for all purposes by this reference.

BACKGROUND OF THE INVENTION

1. Field of the Invention

The present invention relates, in general, to a sub-arm assembly of a window regulator which is coupled in a such a manner that a lower end of a sub arm of a main arm and a sub arm of a window regulator which supports and moves window glass in a vertical direction can slide on a base panel.

2. Description of Related Art

In general, window glass installed in a door of a vehicle is moved in a vertical direction by a window regulator.

A known window regulator and a known sub-arm will be explained with reference to FIG. 1. The window regulator includes a main arm 30 which supports a lower end 70 of glass, a sub-arm 50, and a driving unit for driving the main arm 30. Upper ends of the main arm 30 and sub-arm 50 support the lower end 70 of the glass. A lower end of the main arm 30 is provided with a gear assembly 32 which is rotated by the driving unit. A lower end of the sub-arm 50 is coupled so as to slide along a base panel 10. The main arm 30 and the sub-arm 50 are coupled to cross each other by a hinge mechanism. When the driving unit starts, the main arm 30 and the sub-arm 50 pivot in an X-shaped motion to move the glass up or down.

Next, a known sub-arm assembly will be explained with reference to FIGS. 2 and 3. The lower end of the sub-arm 50 is coupled with the base panel 10 so as to be slidable on the base panel 10. To this end, the base panel 10 is coupled with a sliding rail panel 54 and the rail panel 54 is coupled with a sliding unit 52. The lower end of the sub-arm 50 is coupled with the sliding unit 52 in a hinged manner, so that the angle of combination can change on performance of every sliding operation.

In the sub-arm assembly of such a window regulator, the sliding rail panel 54 is coupled with the base panel 10 in a bolted manner and the sliding unit 52 is coupled with the rail panel 54. Accordingly, the sub-arm assembly has a problem in that it has an increased assembly error and it requires increased labor and time. Owing to the increased assembly error, the glass moves up and down in an inclined state rather than being stably supported when the glass moves up and down. Such an error is most likely attributable to a mounting error of the sliding rail panel 54, because an inclining angle of the glass becomes larger than an assembling angle of the sliding rail panel 54 because the length of the rail is long. That is, if the assembling angle deviates only slightly, the glass is inclined by a comparatively large angle.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY OF THE INVENTION

Various aspects of the present invention are directed to provide a sub-arm assembly of a window regulator which can reduce a sliding angle and a climbing angle of glass by reducing errors during assembly.

In an aspect of the present invention, a sub-arm assembly of a window regulator may include a sub-arm which is pivotally coupled to a main arm of the window regulator in a letter X shape, wherein upper ends of the sub-arm and the main arm are configured to support a lower end of glass and a lower end of the sub-arm is configured to be slidable on a base panel, a sliding bar pivotally coupled the lower end of the sub-arm, and/or a guide rail integrally formed with the base panel so as to extend from the base panel and having a space to slidably receive the sliding bar.

The sub-arm assembly of a window regulator may further include a second guide rail integrally formed with the base panel so as to extend from the base panel and having a space to slidably receive the sliding bar, wherein the guide rail and the second guide rail are disposed with a predetermined distance therebetween.

The guide rail may include a first pair of guide portions extending substantially in a vertical direction from the base panel and being in close contact with upper and lower ends of the sliding bar, respectively, and/or bent portions which are bent from distal ends of the guide portions toward the sliding bar to prevent the sliding bar from becoming detached from the guide portions. The sub-arm assembly of a window may further include a second pair of guide portions extending substantially in a vertical direction from the base panel and being in close contact with upper and lower ends of the sliding bar, respectively, and/or bent portions which are bent from distal ends of the second pair of the guide portions toward the sliding bar to prevent the sliding bar from becoming detached from the second pair of the guide portions, wherein the first pair of the guide portions and the second pair of guide portions are spaced with a predetermined distance therebetween.

The guide rail may include a first pair of guide portions extending substantially in a vertical direction from the base panel and in close contact with upper and lower ends of the sliding bar, respectively, and/or a connection portion connecting upper ends of the guide portions to each other to receive the sliding bar. The sub-arm assembly of a window regulator may further include a second pair of guide portions extending substantially in a vertical direction from the base panel and in close contact with upper and lower ends of the sliding bar, respectively, and/or a connection portion connecting upper ends of the second pair of the guide portions to each other to receive the sliding bar, wherein the first pair of the guide portions and the second pair of guide portions are spaced with a predetermined distance therebetween.

Upper end and/or lower end of the sliding bar may be provided with flanges extending in a lengthwise direction thereof and which are received and slide in the guide rail.

The sliding bar may include a bush member having a predetermined length sufficiently enough to raise the lower end of the sub-arm from the sliding bar so as not to be blocked by the guide rail.

The guide rail may be formed in a manner such that one side of the base panel is pressed so that the other side of the base panel protrudes.

The methods and apparatuses of the present invention have other features and advantages which will be apparent from or are set forth in more detail in the accompanying drawings, which are incorporated herein, and the following Detailed Description of the Invention, which together serve to explain certain principles of the present invention

DETAILED DESCRIPTION OF THE INVENTION

Reference will now be made in detail to various embodiments of the present invention(s), examples of which are illustrated in the accompanying drawings and described below. While the invention(s) will be described in conjunction with exemplary embodiments, it will be understood that present description is not intended to limit the invention(s) to those exemplary embodiments. On the contrary, the invention (s) is/are intended to cover not only the exemplary embodiments, but also various alternatives, modifications, equivalents and other embodiments, which maybe included within the spirit and scope of the invention as defined by the appended claims.

A sub-arm assembly of a window regulator according to various embodiments of the invention will be described with reference to the accompanying drawings.

Figure 1:
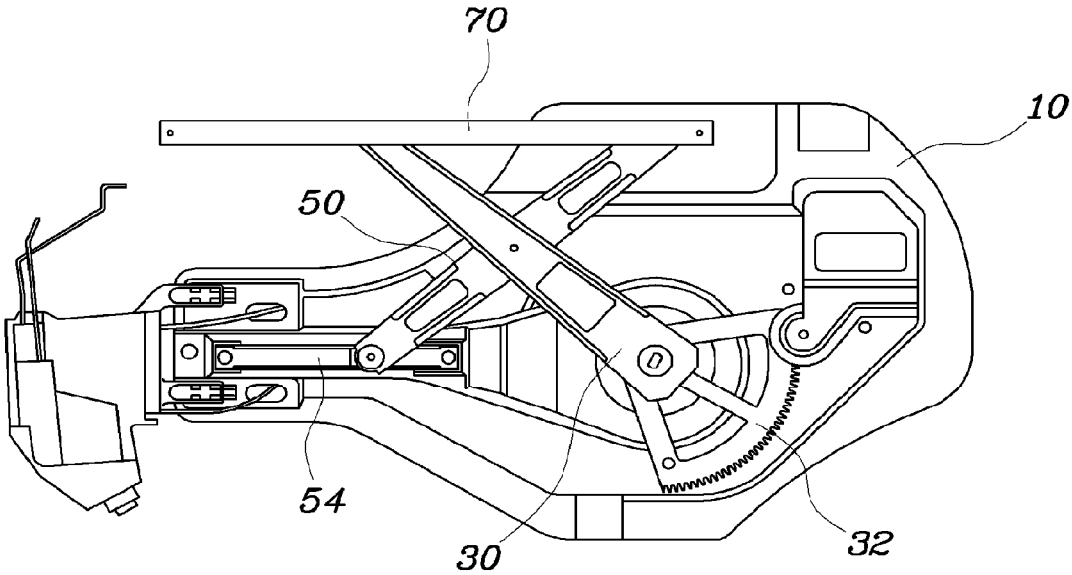
FIG. 1 (Prior Art)
FIG. 1 is a perspective view illustrating a conventional sub-arm assembly of a window regulator.
Figure 2:
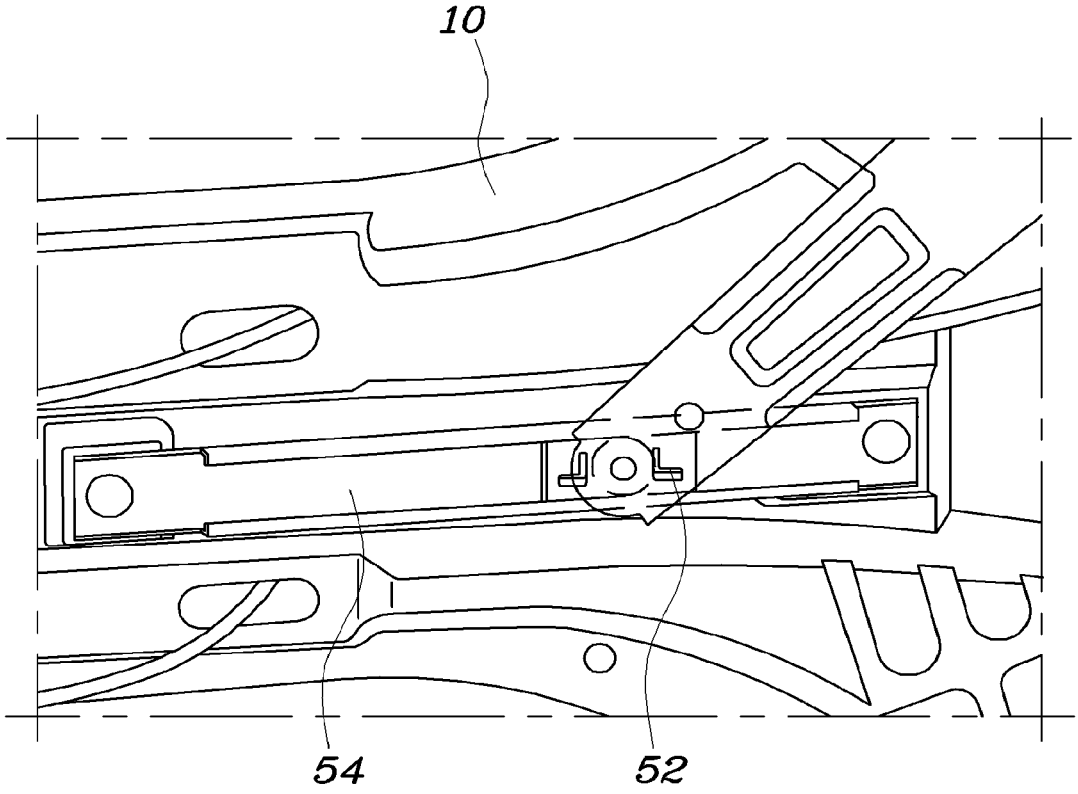
FIG. 2 (Prior Art)
FIG. 2 is a perspective view illustrating a sliding structure of the sub-arm assembly of the window regulator of FIG. 1.
Figure 3:
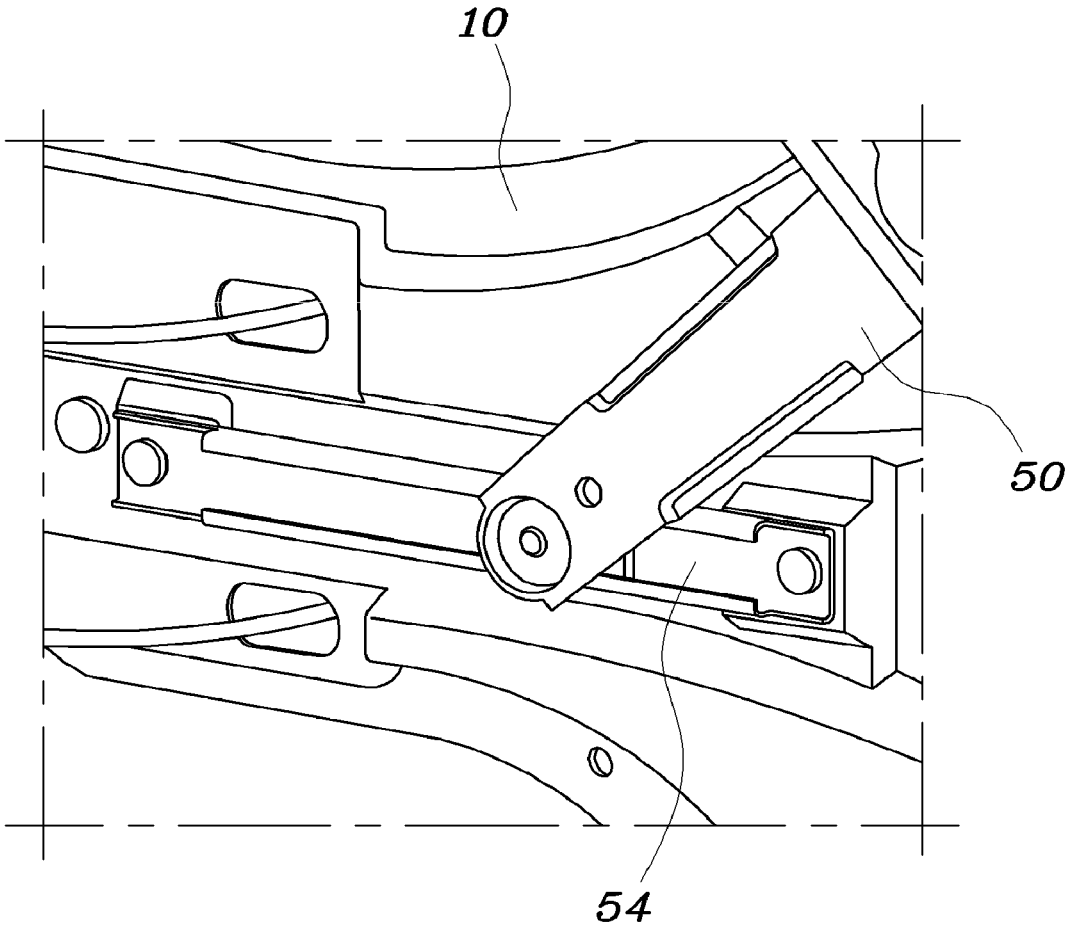
FIG. 3 (Prior Art)
FIG. 3 is an enlarged perspective view illustrating the sub-arm assembly of the window regulator of FIG. 1.
Figure 4:
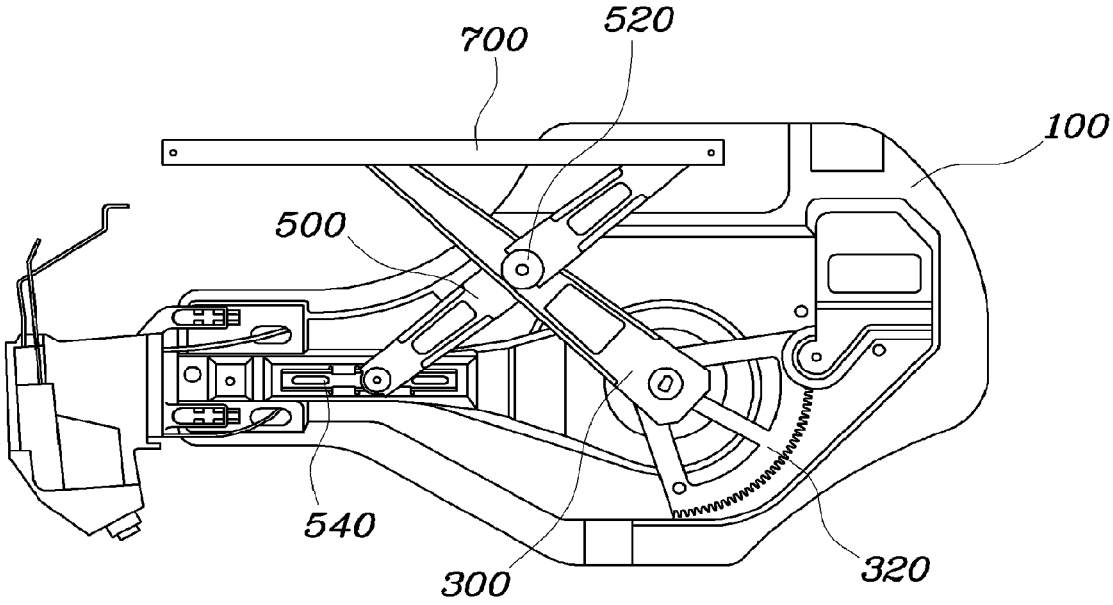
FIG. 4 is a perspective view illustrating a sub-arm assembly of an exemplary window regulator according to the present invention.

FIG. 4 is a perspective view illustrating a sub-arm assembly of a window regulator according to various embodiments of the invention.

The sub-arm assembly of the window regulator includes a sub-arm 500, which is coupled with a main arm 300 of the window regulator so that they cross each other in a hinged manner, and which has an upper end supporting a lower end 700 of glass along with the main arm 300 and a lower end provided to be slidable on a base panel 100; a sliding bar 540 coupled to the lower end of the sub-arm 500 by a hinge pin 542; and a guide rail 120 which is integrally formed with the base panel in a form of extending from the base panel 100 and which has a space in which the sliding bar 540 is inserted and slides. One will appreciate that the guide rail may be monolithically formed with the base panel.

The base panel 100 may be a module panel on which a door panel or a regulator is mounted.

Upper ends of the sub-arm 500 and the main arm 300 support the lower end 700 of the glass. The lower end of the main arm 300 can pivot by a gear assembly 320. The lower end of the sub-arm 500 is coupled with the base panel 100 so as to be slidable on the base panel 100. The main arm 300 and the sub-arm 500 are coupled with each other, crossing each other in the shape of a letter X by a hinge pin 520 and support and move up and down the glass. The lower end of the sub-arm 500 is installed to be slidable on the base panel 100 via the sub-arm assembly.

For sliding of the sub-arm 500, the sliding bar 540 is coupled to the lower end of the sub-arm 500 via the hinge pin 542. When the sliding bar 540 slides, an angle between the sliding bar 540 and the sub-arm 500 naturally changes thanks to the hinge pin 542.

The guide rail 120, to be coupled to the sliding bar 540, has a space in which the sliding bar 540 is inserted and slides, and is provided to extend from the base panel 100. The guide rail 120 is integrally formed with the base panel 100, and therefore the number of components of the sub-arm assembly is reduced. Further, since the guide rail 120 and the base panel 100 are not formed individually and then assembled, assembly errors decrease.

It is preferable that the guide rail 120 be formed by pressing the base panel 100 from one side to the opposite side through press processing. The guide rail 120 is open at both ends and has an inside space in which the sliding bar 540 is inserted and slides. For sliding purposes, the length of the sliding bar 540 must be designed to be sufficient, considering a traveling length of the lower end of the sub-arm 500.

Figure 5:
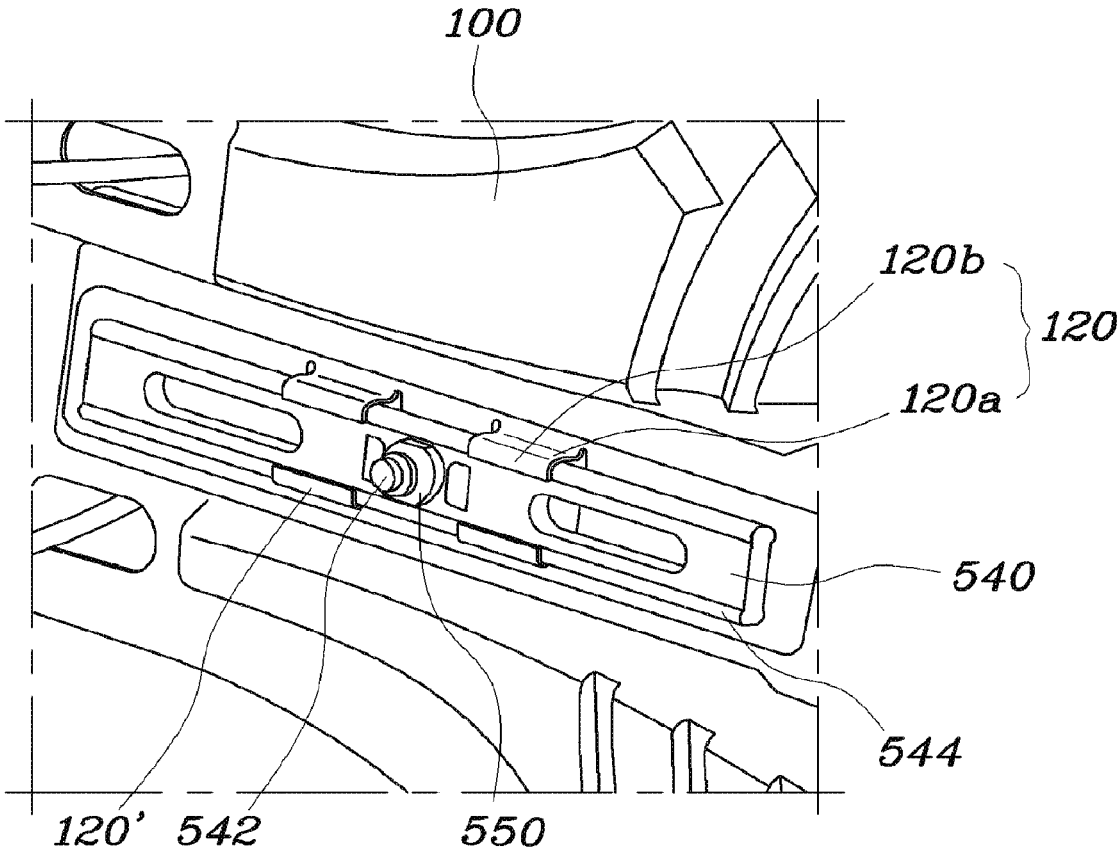
FIG. 5 is a perspective view illustrating a sliding structure of the sub-arm assembly of the window regulator of FIG. 4.

An example of the guide rail will be described with reference to FIG. 5. The guide rail 120 includes a pair of guide portions 120*a* extending in a vertical direction from the base panel 100 while being in close contact with the upper and lower end of the sliding bar 540, and bent portions 120*b* which are bent from distal ends of the guide portions 120*a* and which prevent the sliding bar 540 from being separated.

In this case, the bent portions 120*b* are spaced apart by a predetermined distance, so the hinge pin 542 of the sub-arm 500 can pass through between the bent portions 120*b*. The upper and lower ends of the sliding bar 540 are in close contact with the guide portion 120*a*, so the sliding bar 540 can slide without moving freely. The upper end of the guide portion 120*a* is provided with the bent portion 120*b* which is bent toward the sliding bar 540 and prevents the sliding bar 540 from being separated from the guide portion 120*a*

In various embodiments of the present invention, a bush member 550 may be disposed at the hinge pin 542 so as to raise the lower end of the sub-arm 500 from the sliding bar 540 so that the sub-arm 500 can slide along the guide rail 120 without being blocked.

The guide rails 120 and 120' are spaced away from each other by a predetermined distance. The number of the guide rails may be plural.

A guide rail according to various embodiments of the invention may include a pair of guide portions 120*a* extending in a vertical direction while being in close contact with upper and lower ends of a sliding bar 540 and a connection portion which connects the upper portions of the guide portions 120 a to each other. In this case, thanks to the connection portion which connects the upper ends of the guide portions 12*a* to each other, the sliding bar 540 does not become separated from the guide portion 120*a* and can slide in the guide portion 120*a*.

Since the connection portion is provided at upper ends of the guide portion 12*a* in each guide rails 120 and 120', the hinge pin 542 of the sub-arm cannot pass through the connection. In this configuration, when a pair of the guide rails 120 and 120' is spaced apart from each other by a sufficient distance so as to receive the hinge pin 542 therebetween, the connection portion functions as a stopper of the hinge pin 542.

Figure 6:
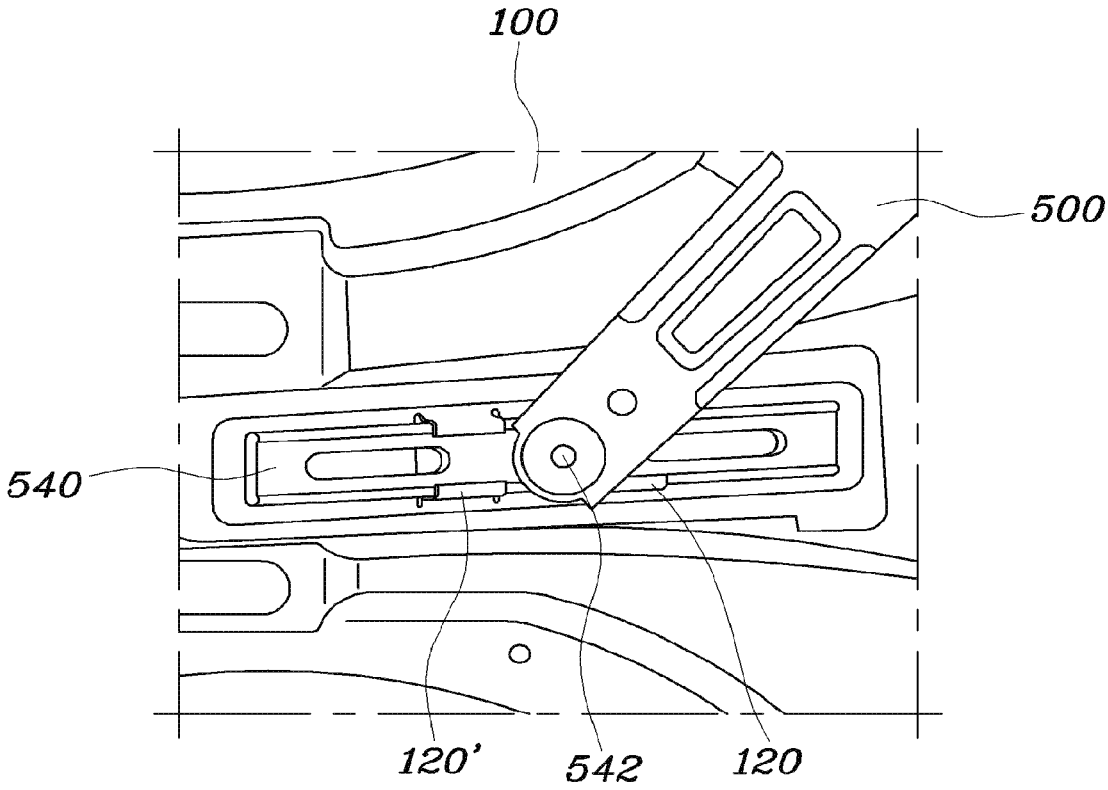
FIG. 6 is an enlarged view illustrating the sub-arm assembly of the window regulator of FIG. 4.

FIG. 6 is a perspective view illustrating operation of the sub-arm assembly of the window regulator according to various embodiments of the present invention. The lower end of the sub-arm 500 is connected to the sliding bar 540 by the hinge pin 542, and the sliding bar 540 slides between the guide rails 120 and 120' integrally formed with the base panel 100. When the glass moves up, the sub-arm 500 is in an upright posture and the sliding bar 540 slides rightward. Conversely, when the glass moves down, the sub-arm 500 changes its posture to extend in a lateral direction and the sliding bar 540 slides leftward. At this time, the lower end of the sub-arm 500 is connected to the sliding bar 540 by the hinge pin 542 and an angle of the sub-arm 500 naturally changes.

The upper and lower ends of the sliding bar 540 are provided with flanges 544 extending in a lengthwise direction, the flanges 544 being received and sliding in the guide rails 120 and 120'. Both ends of the sliding bar 540 are provided with the flanges 544, so that the sliding bar 540 can stably slide.

For convenience in explanation and accurate definition in the appended claims, the terms "upper" and "lower" are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A sub-arm assembly of a window regulator, comprising:

a sub-arm pivotally coupled to a main arm of the window regulator in an X-shape, wherein upper ends of the sub-arm and the main arm are configured to support a lower end of glass and a lower end of the sub-arm is configured to be slidable on a base panel;

a sliding bar pivotally coupled to the lower end of the sub-arm; and a guide rail integrally formed with the base panel so as to extend from the base panel and having a space to slidably receive the sliding bar;

wherein a length of the guide rail in a movement direction of the sliding bar is shorter than a length of the sliding bar in the movement direction of the sliding bar, wherein the guide rail comprises:

a first pair of guide portions extending substantially in a vertical direction from the base panel and being in close contact with upper and lower ends of the sliding bar, respectively;

bent portions which are bent from distal ends of the guide portions toward the sliding bar to prevent the sliding bar from becoming detached from the guide portions;

a second pair of guide portions extending substantially in a vertical direction from the base panel and being in close contact with upper and lower ends of the sliding bar, respectively; and bent portions which are bent from distal ends of the second pair of the guide portions toward the sliding bar to prevent the sliding bar from becoming detached from the second pair of the guide portions, wherein the first pair of the guide portions and the second pair of guide portions are spaced with a predetermined distance therebetween.

2. The sub-arm assembly of a window regulator according to claim 1, further comprising a second guide rail integrally formed with the base panel so as to extend from the base panel and having a space to slidably receive the sliding bar, wherein the guide rail and the second guide rail are disposed with a predetermined distance therebetween.

3. The sub-arm assembly of a window regulator according to claim 1, wherein the guide rail comprises:

a first pair of guide portions extending substantially in a vertical direction from the base panel and in close contact with upper and lower ends of the sliding bar, respectively; and a connection portion connecting upper ends of the guide portions to each other to receive the sliding bar.

4. The sub-arm assembly of a window regulator according to claim 3, further comprising:

a second pair of guide portions extending substantially in a vertical direction from the base panel and in close contact with upper and lower ends of the sliding bar, respectively; and a connection portion connecting upper ends of the second pair of the guide portions to each other to receive the sliding bar, wherein the first pair of the guide portions and the second pair of guide portions are spaced with a predetermined distance therebetween.

5. The sub-arm assembly of a window regulator according to claim 1, wherein at least one of upper end and lower end of the sliding bar is provided with flanges extending in a lengthwise direction thereof and which are received and slide in the guide rail.

6. The sub-arm assembly of a window regulator according to claim 1, wherein the sliding bar comprises a bush member having a predetermined length sufficiently enough to raise the lower end of the sub-arm from the sliding bar so as not to be blocked by the guide rail.

7. The sub-arm assembly of a window regulator according to claim 1, wherein the guide rail is formed in a manner such that one side of the base panel is pressed so that the other side of the base panel protrudes.

8. A vehicle door comprising the sub-arm assembly of the window regulator according to claim 1.

9. A vehicle comprising the vehicle door according to claim 8.

* * * * *